US006305636B1

(12) United States Patent
Satoh et al.

(10) Patent No.: US 6,305,636 B1
(45) Date of Patent: Oct. 23, 2001

(54) WEB DRIVING DEVICE

(75) Inventors: Masahiko Satoh, Funabashi; Takayuki Seki, Yokohama, both of (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/421,219

(22) Filed: Oct. 20, 1999

(30) Foreign Application Priority Data

Oct. 23, 1998 (JP) ..... 10-303048
Dec. 2, 1998 (JP) ..... 10-342841

(51) Int. Cl.[7] ..... B65H 18/10

(52) U.S. Cl. ..... 242/538.2; 242/538.1; 399/327

(58) Field of Search ..... 242/538, 538.1, 242/538.2, 538.3, 538.4, 343, 352, 356.2; 399/327; 40/471, 518, 519

(56) References Cited

U.S. PATENT DOCUMENTS

| | | | | |
|---|---|---|---|---|
| Re. 36,124 | | 3/1999 | Yokoyama et al. | 399/330 |
| 861,336 | * | 7/1907 | Veneziani | 40/518 |
| 1,760,664 | * | 5/1930 | Rosenfield | 40/471 |
| 2,482,615 | * | 9/1949 | Fowler | 40/471 |
| 3,266,745 | * | 8/1966 | Benson | 242/538 |
| 4,591,879 | * | 5/1986 | Yokota et al. | 242/538 |
| 5,300,996 | | 4/1994 | Yokoyama et al. | 355/285 |
| 5,625,442 | | 4/1997 | Seki | 399/327 |
| 5,749,037 | | 5/1998 | Takayuki | 399/327 |
| 5,832,354 | | 11/1998 | Kouno et al. | 399/327 |
| 5,915,147 | | 6/1999 | Kouno et al. | 399/69 |
| 5,970,298 | | 10/1999 | Seki et al. | 399/327 |
| 6,079,660 | * | 6/2000 | Manusch et al. | 242/538.1 |

FOREIGN PATENT DOCUMENTS

| | | |
|---|---|---|
| 4029841 | 3/1991 | (DE) . |
| 0871087 | 10/1998 | (EP) . |
| 60-263184 | 12/1985 | (JP) . |
| 8-185074 | 7/1996 | (JP) . |
| 08091655 A | 9/1996 | (JP) . |
| 09292792 A | 11/1997 | (JP) . |

* cited by examiner

*Primary Examiner*—John M. Jillions
(74) *Attorney, Agent, or Firm*—Oblon, Spivak, McClelland, Maier & Neustadt, P.C.

(57) ABSTRACT

A web driving device including a web, a winding axis connected to a first end of the web and configured to rotate and wind the web about the winding axis in a winding direction, and a supplying axis connected to a second end of the web and configured to rotate. The web driving device further includes a driving device configured to drive the winding axis in the winding direction. The driving device is configured to prevent rotation of the winding axis when the driving device is in an inactive condition. The web driving device further advantageously includes an intermediate gear device engaged to the winding axis and configured to restrict rotation of the supplying axis when the winding axis stops rotating.

16 Claims, 9 Drawing Sheets

WEB DRIVING DEVICE

CROSS-REFERENCE TO RELATED APPLICATIONS

The present document incorporates by reference the entire contents of Japanese priority document 10-303048 filed in Japan on Oct. 23, 1998 and Japanese priority document 10-342841 filed in Japan on Dec. 2, 1998.

BACKGROUND OF THE INVENTION

1. Field of the Invention

The present invention relates a to web driving device for cleaning an object or for applying liquid such as oil to an object by the action of contact. The web driving device is equipped in a device such as an image forming apparatus (e.g., a copier, a facsimile, or a printer). More specifically, the web driving device is equipped in a fixing device or a photosensitive device in the image forming apparatus.

2. Discussion of the Background

A conventional web driving device, as depicted in FIG. 1, is equipped in a fixing device. The fixing device generally includes a fixing roller 1 that has a heater 3 inside such that a surface of the fixing roller 1 is heated and controlled at prescribed temperature. A press roller 2 presses the fixing roller 1 and makes a nip portion between them. When a sheet of paper 5 having unfixed toner image thereon is fed through the nip portion, the toner image is fixed to the paper 5. The fixing device further includes a web device having a web 44 made of an unwoven wiper that is constructed of aramid fiber mixed with PET (polyethylene terephthalate) fiber. The web 44 contains oil as required. One edge of the web 44 is fixed to a winding axis 42 and another edge of the web is fixed to a supplying axis 43. Most of the web 44 is wound in the supplying axis 43 in initial condition. A pressing roller 45 is located between the winding axis 42 and supplying axis 43 for pressing the web 44 to the fixing roller 1. The web 44 is moved step by step and then the web 44 removes a residual quantity on the fixing roller 1 or supplies oil to the fixing roller 1. A motor 72 drives the winding axis 42 for winding the web 44 at a constant angle in one action via a transferring mechanism 71 such as a gear or a timing pulley. The pressing roller 45 has a layer made of a silicon rubber or a forming rubber on a core metal.

Construction of the web driving device and amount of sending (or unwinding) of the web has numerous variations depending upon the manner in which the image forming apparatus is going to be utilized. The amount of sending is generally limited to a small amount because the web 44 is restricted in length or setting space. More specifically, the amount of sending is generally limited to between 0.5 mm/hour and 2 mm/hour.

In this conventional web driving device, there is a problem that when the web is pulled unexpectedly (for example during a paper jam) and the fixing roller is manually rotated via a handling knob, then the winding axis is rotated in conjunction with the fixing roller. The reason why the problem comes up is the winding axis is usually put only under light load for helping the supplying axis for taking up the web. More specifically, when a paper 5 is jammed, as depicted in FIG. 2(*a*), and the paper 5 is taken out along a normal feeding direction (indicated by an arrow), the web 44 may not be drawn by a torque of the fixing roller 1 as the winding axis 42 is locked by the motor 72 in an undriving condition. However, when a paper 5, as depicted in FIG. 2(*b*), is taken out along a counter direction of the normal feeding direction (indicated by an arrow), the web 44 is drawn by a torque of the fixing roller 1 (as shown using a dotted lines) because the supplying axis 43 is not locked. Accordingly, cleaning ability of the web 44 is reduced. Furthermore, the web 44 may be caught in the nip portion by the slack when the printing action restarts.

To solve the above problem, a device is disclosed in a Laid-Open Japanese Patent Application No. 08-185074. The device has a locking mechanism for preventing the looseness of the web. The device has a supplying axis including a ratchet gear at the edge thereof, a winding axis for taking up the web, a solenoid actuated in response to winding action of the winding axis.

The solenoid has a ratchet hook that is engaged with the ratchet gear only when the winding axis rotates. However, as a controller must control the action of the solenoid and the action of the winding axis accurately, controlling by the controller becomes difficult. Furthermore, the device must have a ratchet hook and a solenoid of increased rigidity in order to insure that the rotation of the supplying axis is properly stopped. Therefore the device must be upsized.

SUMMARY OF THE INVENTION

Accordingly, an object of this invention is to provide a novel web driving device that overcomes the above-mentioned limitations of existing methods and systems.

Another object of the present invention is to provide a novel web driving device that actuates with reliability.

The present invention provides a web driving device including a web, a winding axis connected to a first end of the web and configured to rotate and wind the web about the winding axis in a winding direction, and a supplying axis connected to a second end of the web and configured to rotate. The web driving device further includes a driving device configured to drive the winding axis in the winding direction. The driving device is configured to prevent rotation of the winding axis when the driving device is in an inactive condition. The invention further advantageously provides an intermediate gear device engaged to the winding axis and configured to restrict rotation of the supplying axis when the winding axis stops rotating.

The present invention advantageously includes a first embodiment where the supplying axis includes a first protrusion fixed thereto, and the intermediate gear device includes a second protrusion fixed thereto. In this embodiment the second protrusion is configured to engage the first protrusion to prevent the supplying axis from rotating in at least one direction when the driving device is in the inactive condition. The first protrusion and the second protrusion are preferably configured to allow relative rotation between the supplying axis and the intermediate gear device in a first direction but prevent relative rotation between the supplying axis and the intermediate gear device in a direction opposite to the first direction. The first protrusion is incorporated in a cam surface attached to the supplying axis and the supplying axis is biased towards the intermediate gear device to maintain contact between the second protrusion and the cam surface during rotation of the supplying axis and the intermediate gear device.

The present invention advantageously includes a second embodiment where the supplying axis includes a one-way gear assembly having a one-way clutch configured to engage the supplying axis with the intermediate gear device and prevent the supplying axis from rotating in at least one direction when the driving device is in the inactive condition.

The present invention further advantageously includes a third embodiment where the intermediate gear device includes a first portion engaged to the supplying axis and having a first tooth and a second portion engaged to the winding axis and having a second tooth. The second tooth is configured to engage the first tooth to prevent the supplying axis from rotating in at least one direction when the driving device is in the inactive condition. The first tooth and the second tooth are preferably configured to allow relative rotation between the first portion and the second portion in a first direction but prevent relative rotation between the first portion and the second portion in a direction opposite to the first direction.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 2(*b*) illustrates the conventional fixing device of FIG. 1, where a paper jam is dislodged in a direction towards the right side of the figure;

FIG. 3(*b*) illustrates an interaction between a restricting part and a stopper of the first embodiment;

FIG. 3(*c*) illustrates an interaction between the restricting part and the stopper in relation to a supplying axis and a web;

DESCRIPTION OF THE PREFERRED EMBODIMENTS

Figure 1:
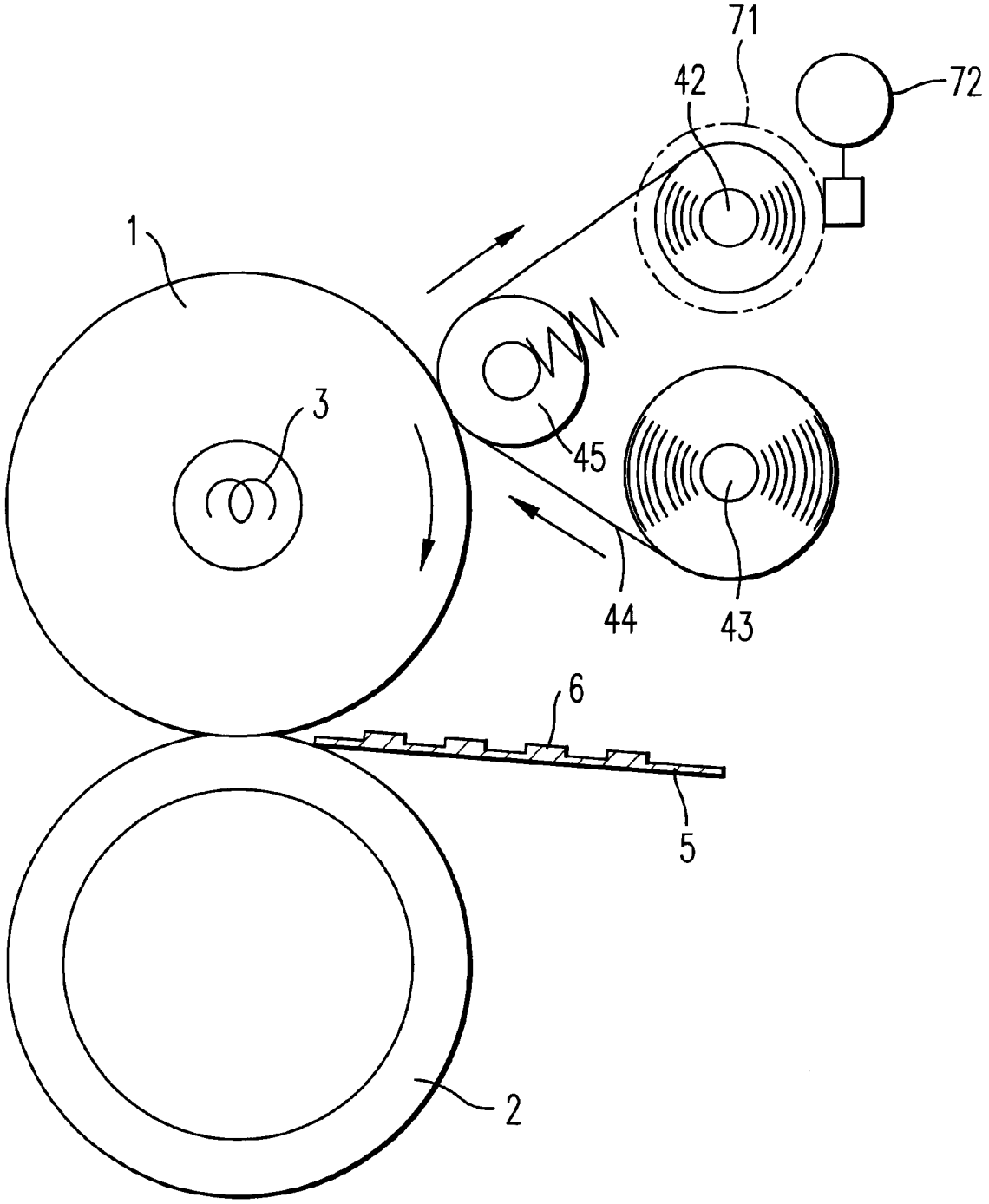
FIG. 1 illustrates a conventional fixing device including a web driving device.
Figure 2A:
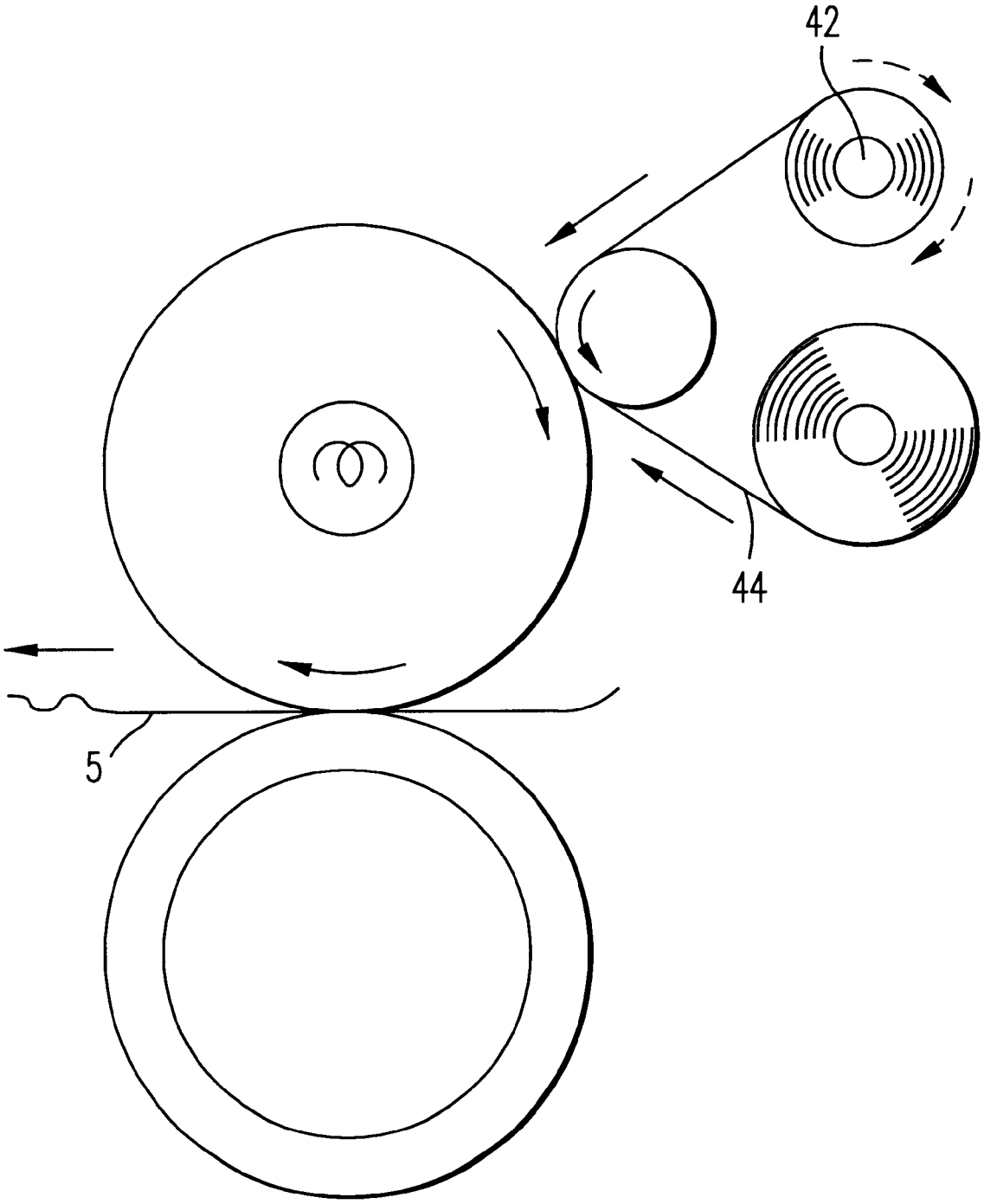
FIG. 2(*a*) illustrates the conventional fixing device of FIG. 1, where a paper jam is dislodged in a direction towards the left side of the figure.
Figure 2B:
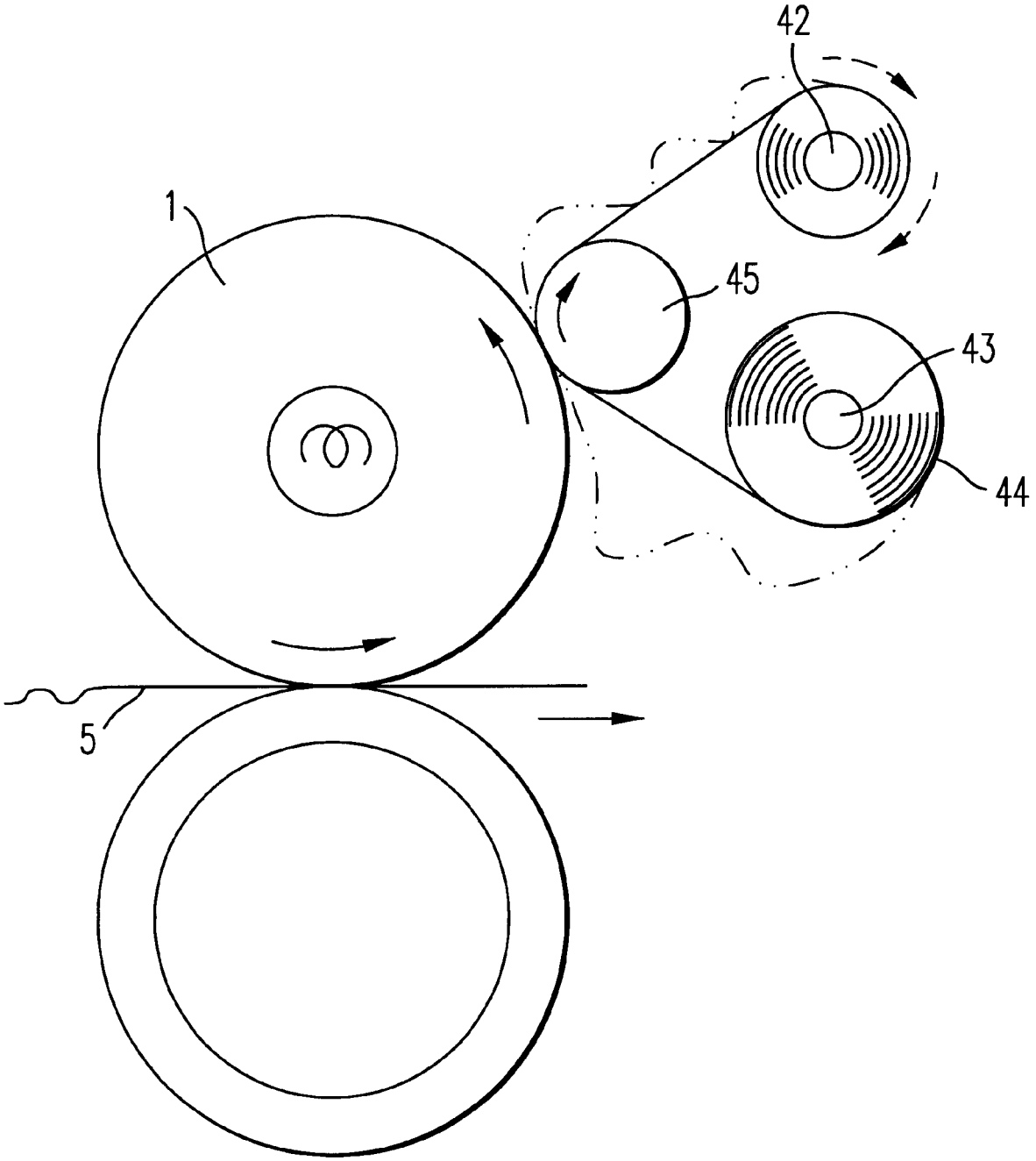
Figure 3A:
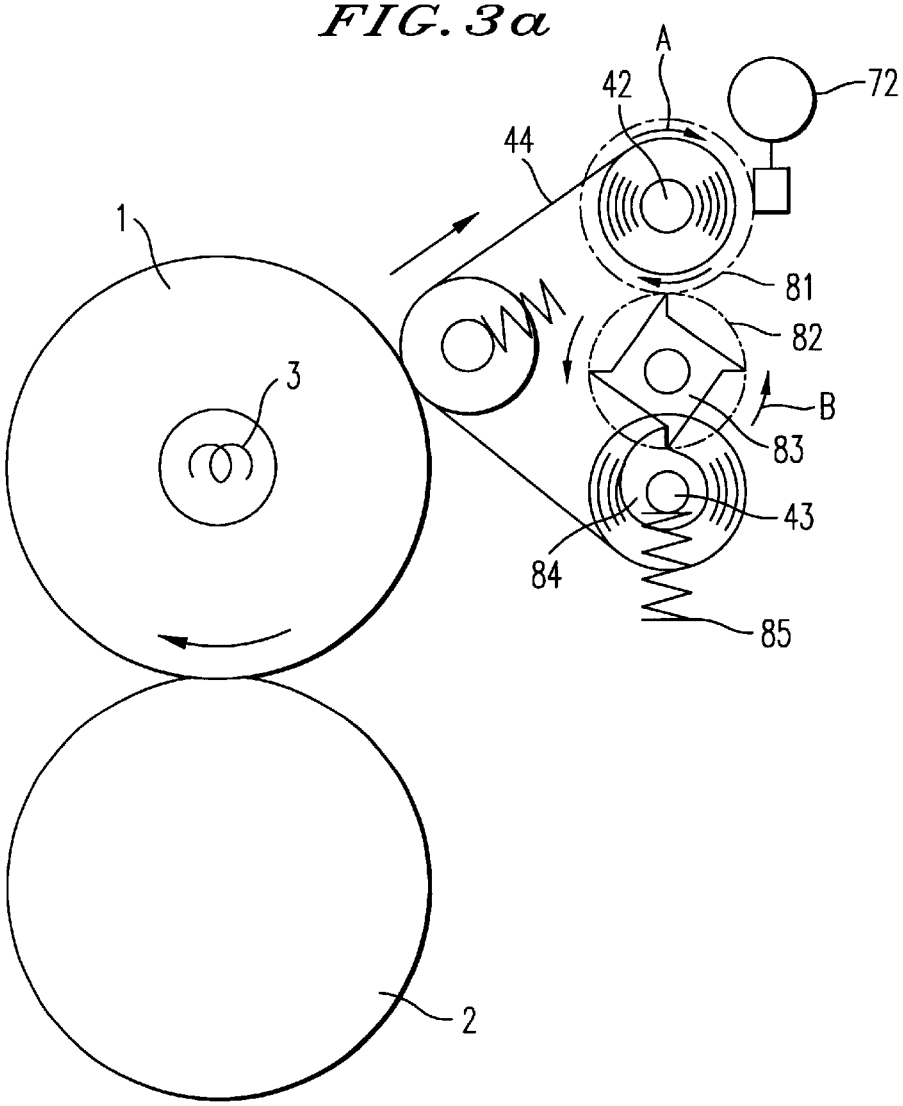
FIG. 3(*a*) illustrates a first embodiment of a web driving device according to the present invention.
Figure 3B:
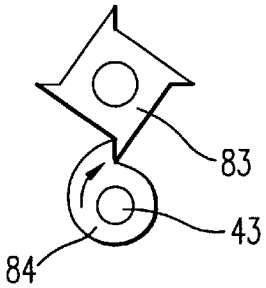
Figure 3C:
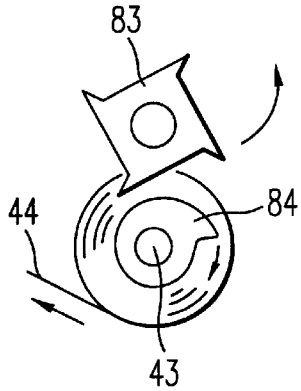

Referring now to the drawings, where like reference numerals identify the same or corresponding parts throughout the several views, FIGS. 3(*a*)–3(*c*) depict a first embodiment of the present invention which is adopted in a fixing device of an image forming apparatus.

The embodiment of the web driving device depicted in FIG. 3(*a*) has a web 44, a winding axis 42, a supplying axis 43, a motor 72, a transferring gear 81 for transferring torque of the motor 72 to the winding axis 42, and an intermediate gear 82 having a restricting part 83. Since the motor 72 is configured to rotate in only one direction, the winding axis 42 can rotate in only one direction, called the winding direction (depicted as a clockwise direction), as shown by an arrow A. The winding axis 42 cannot rotate while the motor 72 is stopped. The transferring gear 81 rotates in the same direction as the winding direction.

The intermediate gear 82 is placed between the winding axis 42 and the supplying axis 43. As the intermediate gear 82 is engaged with the transferring gear 81, when the winding axis 42 winds the web 44 the intermediate gear rotates in a direction opposite that of the winding direction, as shown by an arrow B. The restricting part 83 is concentrically connected with the intermediate gear 82. The supplying axis 43 has a stopper 84 in an end of the supplying axis 43. The stopper 84 has a cam body that is generally helical in shape and that is engaged with the restricting part 83. The stopper 84 is movably pushed towards the restricting part 83 by a spring 85 in normal condition.

As depicted in FIG. 3(*b*), when the restricting part 83 is stopped due to the restricting part 83 being meshed with the stopper 84, the supplying axis 43 cannot rotate and a new part of the web 44 is prevented from unwinding from the supplying axis. When the motor 72 starts to drive the winding axis 42, the restricting part 83 also rotates, as depicted in FIG. 3(*c*), thereby freeing the restriction of the stopper 84 and allowing the supplying axis 43 to rotate. To insure that the rotational speed of the restricting part 83 is always faster than the rotational speed the stopper 84, the stopper 84 does not collide with the restricting part 83 when the motor 72 drives the winding axis 42. When the restricting part 83 overtakes and passes the stopper 84, the stopper 84 moves away along helical shape thereof against the spring 85.

It is favorable that the stopper 84 moves around a contact point of the fixing roller 1 and the web 44. Then the web 44 is not loose and unstable.

In this embodiment, the restricting part 83 includes four projections and the cam body includes one projection of the cam body, however the number of projections on the restricting part and on the cam body can be varied depending upon the desired amount of sending of the web 44.

Figure 4:
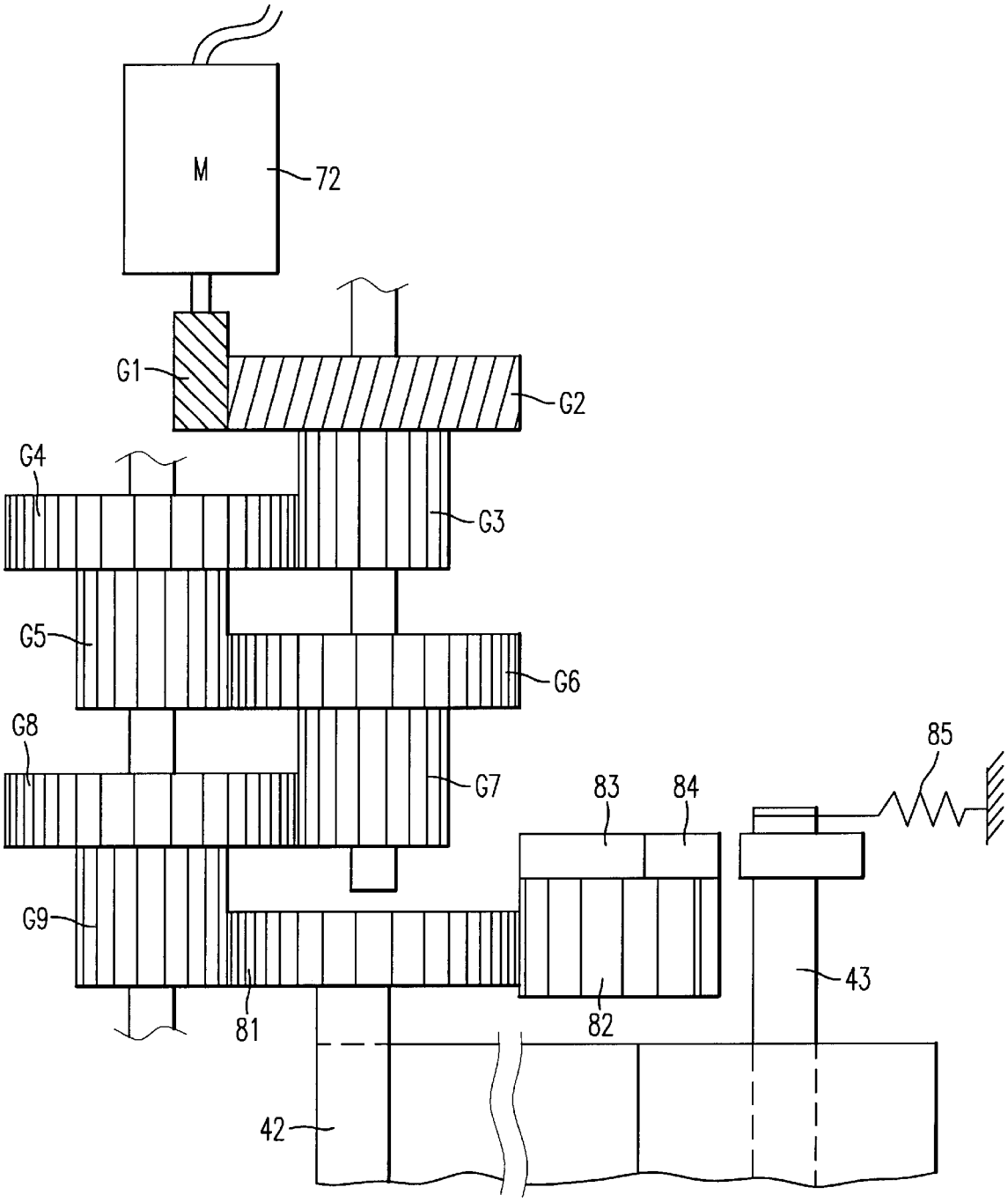
FIG. 4 illustrates a motor and gear system according to the present invention.

The restricting part 83 is stopped by providing a motor that has a breaking function. An embodiment of such a motor and a gear system is depicted in FIG. 4. The motor 72 has a gear GI. The motor 72 drives the winding axis 42 via reduction gears G2 to G9 and transferring gear 81. The intermediate gear 82 engages with the transferring gear 81 that is nearest to the winding axis 42 among the reduction gears. In this configuration, as the breaking function made from the gear ratio of the reduction gears is added to the breaking function of the motor 72, the rotational stop of the restricting part 83 becomes sure.

Figure 5:
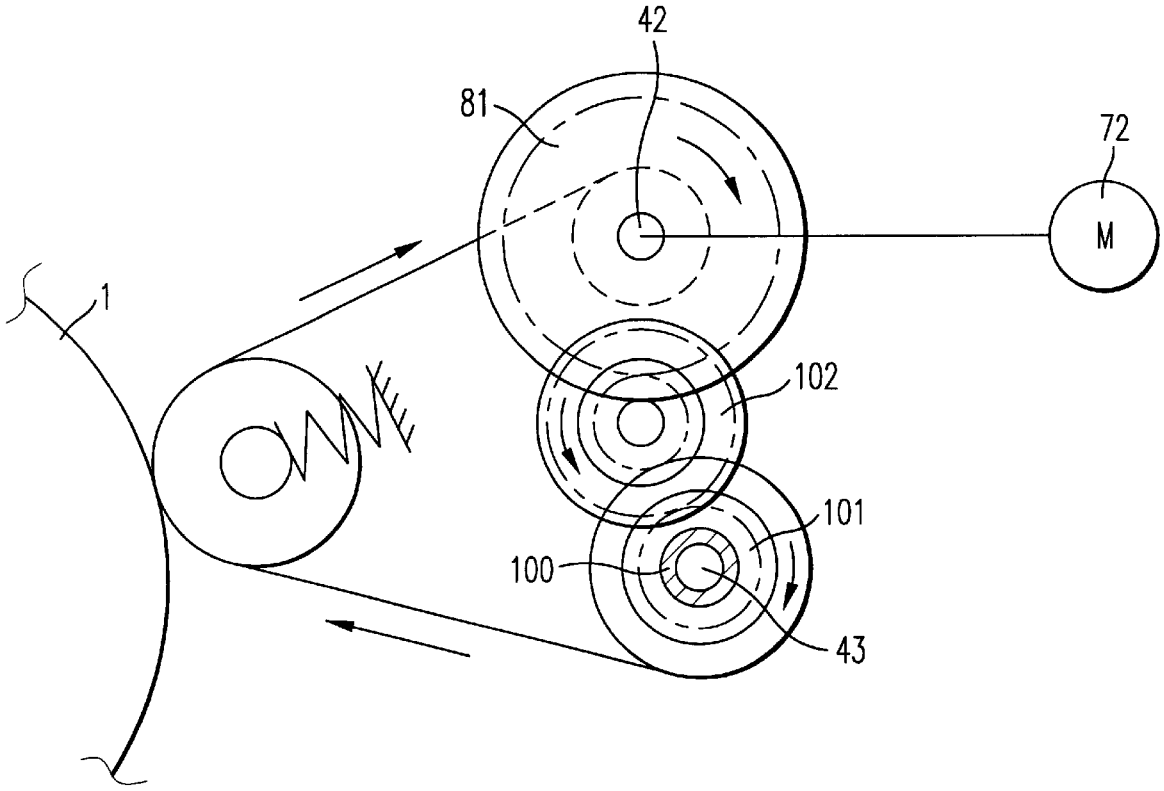
FIG. 5 illustrates a second embodiment of a web driving device according to the present invention.

FIG. 5 depicts a second embodiment of the present invention. In the second embodiment a transferring gear 81 is set at an end of a winding axis 42, and a one-way gear 101 including a one-way clutch 100 is set at an end of a supplying axis 43. The transferring gear 81 is meshed with an intermediate gear 102, and the intermediate gear 102 is meshed with the one-way gear 101. In this embodiment, the intermediate gear 102 is constructed as a two-step gear whose teeth are different from each other. However, alternatively, it is possible to use a normal gear instead of the two-step gear.

An outer ring of the one-way clutch 100 is rotated in conjunction with the one-way gear 101 and an inner ring of the one-way clutch 100 is rotated in conjunction with the supplying axis 43 at all times. When the winding axis 42 rotates, the one-way gear 101 is always rotated by the intermediate gear 102 at a constant rotational speed. However, when the rotational speed of the one way-gear 101 is faster than the rotational speed of the supplying gear 43, it is constituted so that the inner ring races for the outer ring. When the inner ring and the outer ring rotate such that the rotational speed of the outer ring is greater than or equal to the rotational speed of the inner ring, then the one-way clutch 100 goes into a freewheeling condition. On the other hand, when the inner ring and the outer ring are rotating such that the rotational speed of the outer ring is less than the rotational speed of the inner ring, then the one-way clutch 100 is locked.

Figure 6:
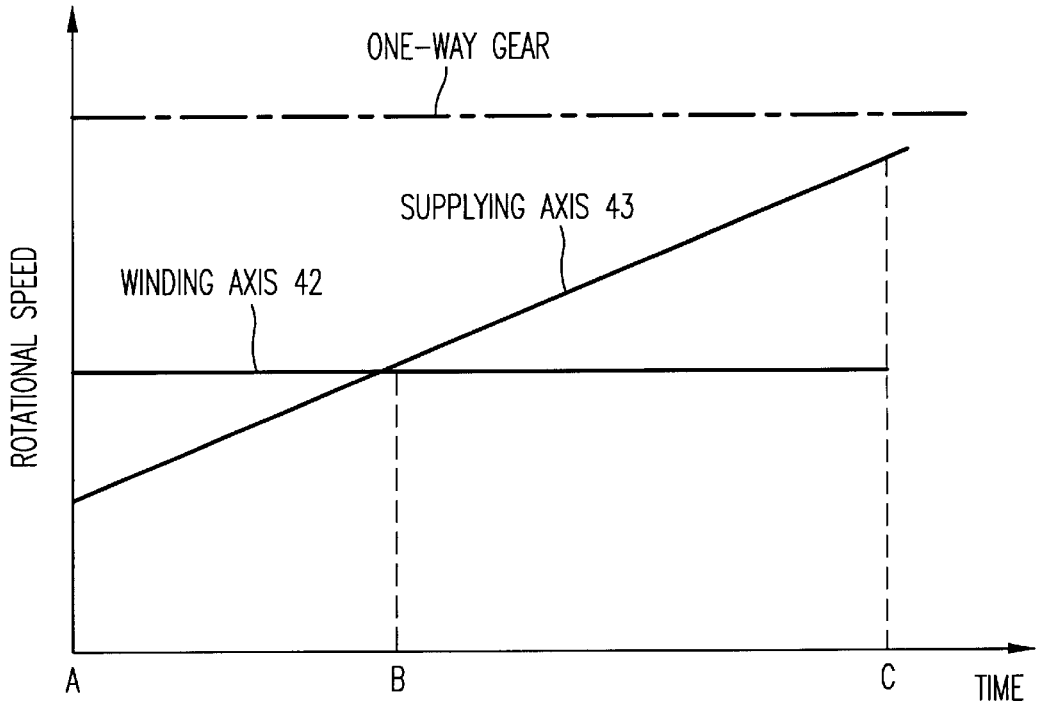
FIG. 6 is a graphical representation of the rotational speed of the supplying axis and of the winding axis.

FIG. 6 is a graphical representation of how the rotational speed of the supplying axis 43 and of the winding axis 42 change over time. Point A indicates when the web driving action starts, point B indicates when the rotational speed of the supplying axis 43 becomes the same as that of the winding axis 42, and point C indicates when the supplying axis 43 becomes empty of the web 44. This graph shows that the winding axis 42 is rotated always at a constant level by the driving motor 72, but the supplying axis 43 increases speed as a diameter of the winding axis 42 gradually becomes bigger. Accordingly, when designing a reduction ratio of the transferring gear 81, the one-way gear 101, and the intermediate gear 102, it is important to take into account that the rotational speed of the one-way gear 101 is faster than the rotational speed of the supplying axis 43 at the point C. A torque of the oneway clutch is commonly low so that it is desirable to include a plate spring to load a tension against the supplying axis 43 within a level that winding action runs easily.

Figure 7:
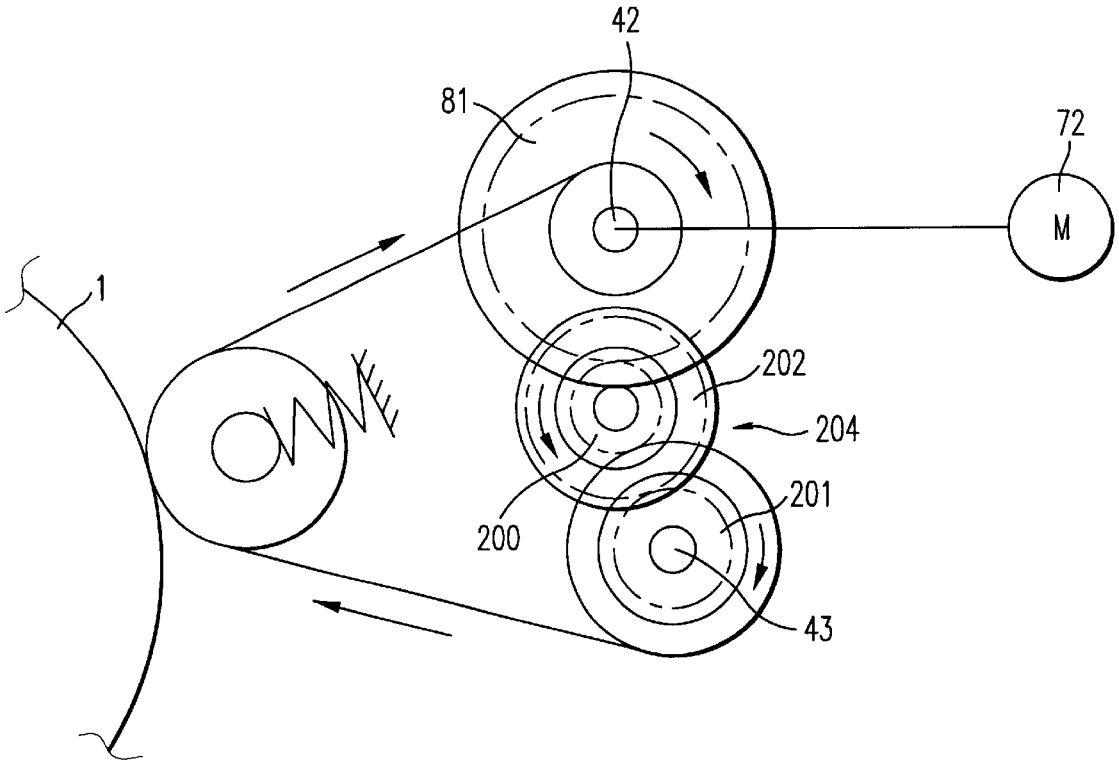
FIG. 7 illustrates a third embodiment of a web driving device according to the present invention.
Figure 8:
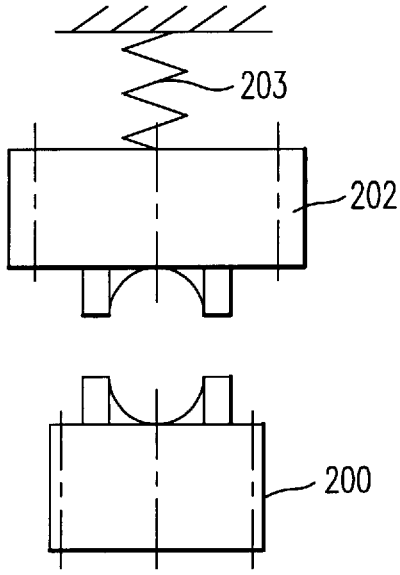
FIG. 8 illustrates a relationship between a small gear and a large gear of the third embodiment.
Figure 9:
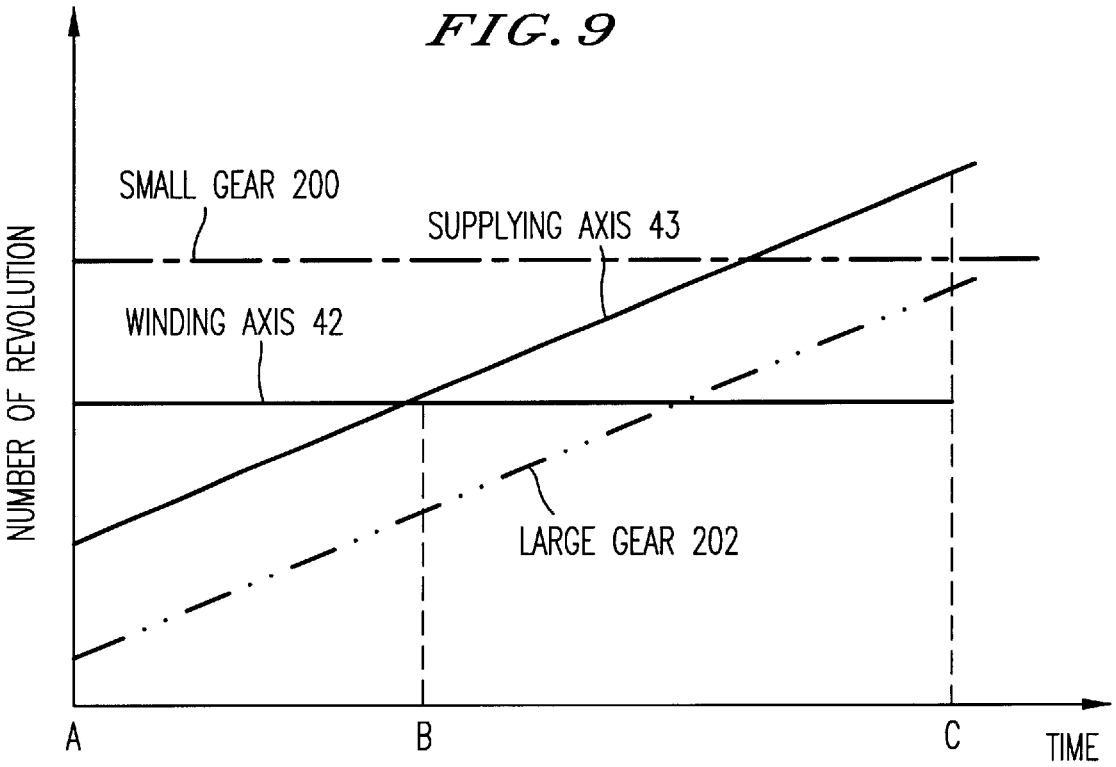
FIG. 9 is a graphical representation of the rotational speed of various gears of the third embodiment.

FIGS. 7 and 8 depict a third embodiment of the present invention. The third embodiment includes an intermediate gear 204 that has a small gear 200 and a large gear 202, whose diameter is larger than the small gear 200. The small gear 200 and the large gear 202 each have at least one lug as depicted in FIG. 8. The small gear 200 is engaged with a transferring gear 81, and the large gear 202 is engaged with a driving gear 201 set at an end of a supplying axis 43. The large gear 202 has a spring 203 for pressing the large gear 202 to the small gear 200 in a normal condition. When winding a web 44, the large gear 202 and the small gear 200 are rotated in same direction (in a clockwise direction in FIG. 7). As mentioned above, the outer diameter of the winding axis 42 increases as the web 44 is wound onto the winding axis which increases a rotational speed of the supplying axis 43. Accordingly, the larger gear 202 is also rotated faster with time. The small gear 200 is, of course, rotated at a constant level. In this embodiment, a reduction ratio of the transferring gear 81 and the small gear 200 and a reduction ratio of the driving gear 201 and the large gear 202 always satisfy the following relationship: the number of revolutions of the small gear 200 are greater than or equal to the number of revolutions of the large gear 202, as depicted in FIG. 9, when the web 44 is wound.

Figure 10A:
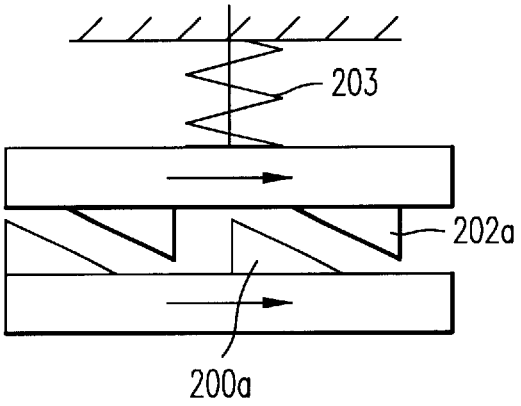
FIGS. 10(*a*) and 10(*b*) illustrate a relationship between lugs of the small gear and lugs of the large gear of the third embodiment when the small gear is rotating faster than the large gear.
Figure 10B:
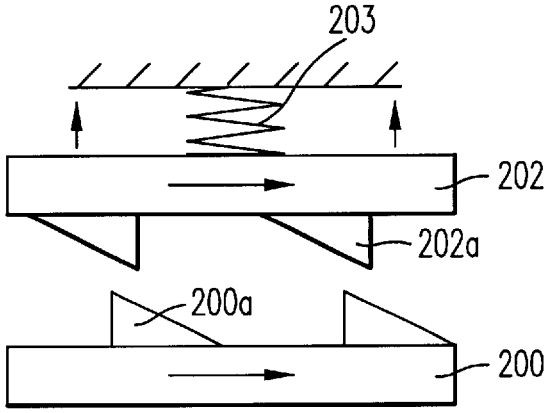
Figure 11A:
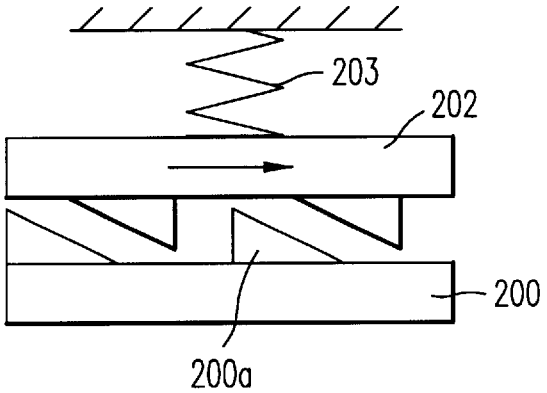
FIGS. 11 (*a*) and 11 (*b*) illustrate a relationship between lugs of the small gear and lugs of the large gear of the third embodiment when the small gear is stationary.
Figure 11B:
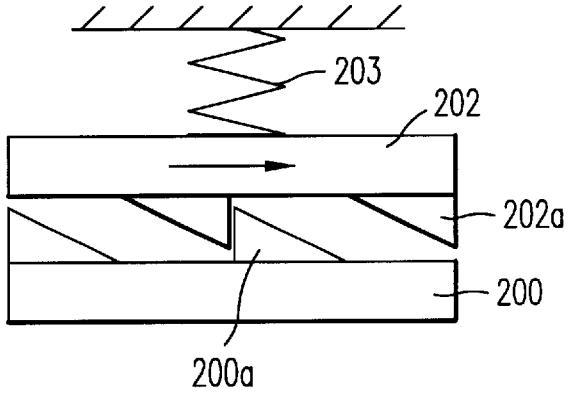

FIGS. 10(*a*), 10(*b*), 11(*a*), and 11 (*b*) depict a relationship of the lugs of the large gear 202 and the lugs of the small gear 200. When the web 44 is wound, as the small gear 200 rotates faster than the large gear 202, the small gear 200 passes the large gear 202. When passing, the slopes of the small gear's lug (or tooth) 200*a* pushes the slopes of the large gear' lug (or tooth) 202*a* and the large gear 202 is moved away against the spring 203 in the axis' direction, as depicted in FIG. 10(*b*). When the winding action is stopped (the motor 72 is at rest), then the small gear 200 is fastened. So the web 44 is not pulled, even if the fixing roller is manually rotated in a normal fixing direction by a knob, which is not shown but that is usually set at an end of a pursuer roller 2, when a paper jam occurs. More specifically, as depicted in FIGS. 11 (*a*) and 11 (*b*), vertical portions of the small gear's lug 200*a* are engaged with vertical portions of the large gear's lugs 202*a* so that the large gear 202 is restricted from moving. In this embodiment, as the large gear 202 is moved for the axis's direction of the large gear 202, we need not consider web's looseness caused by the moving action of the large gear 202.

In above-mentioned embodiments, as the device has mechanically restrictive parts, the web is not pulled unnecessarily with stability in spite of very simplified structure.

Obviously, numerous modifications and variations of the present invention are possible in light of the above teachings. It is therefore to be understood that within the scope of the appended claims, the invention may be practiced otherwise than as specifically described herein.

What is new and desired to be secured by Letters Patent of the United States:

1. A web driving device comprising:

a web configured to scrub an object;

a winding axis connected to a first end of the web, and configured to rotate and wind the web in a winding direction;

a supplying axis connected to a second end of the web, and configured to supply a new part of the web and rotate in a supplying direction;

a driving device configured to drive the winding axis in the winding direction;

lock means for preventing the winding axis from rotating in a direction opposite to the winding direction; and restricting means for restricting rotation of the supplying axis when the winding axis stops rotating, wherein the restricting means is driven by the driving device when the driving device is active, the restricting means is stopped when the driving device is inactive, and the restricting means allows relative rotation between the supplying axis and the winding axis in a first direction and prevents relative rotation between the supplying axis and the winding axis in a second direction opposite the first direction.

2. A web driving device according to claim 1, wherein:

the lock means has at least one transferring gear located between the driving device and the winding axis; and the restricting means is driven by the driving device through the at least one transferring gear.

3. A web driving device according to claim 1, wherein;

the lock means has a plurality of transferring gears located between the driving device and the winding axis; and the restricting means is driven by the driving device through a transferring gear closest to the winding axis.

4. A web driving device according to claim 1 comprising:

a web configured to scrub an object;

a winding axis connected to a first end of the web, and configured to rotate and wind the web in a winding direction;

a supplying axis connected to a second end of the web, and configured to supply a new part of the web and rotate in a supplying direction;

a driving device configured to drive the winding axis in the winding direction;

lock means for preventing the winding axis from rotating in a direction opposite to the winding direction; and restricting means for restricting rotation of the supplying axis when the winding axis stops rotating, wherein the restricting means is driven by the driving device when the driving device is active and the restricting means is stopped when the driving device is inactive, wherein the restricting means has a one-way gear having a one-way clutch equipped in the supplying axis, whereby the supplying axis is restricted to rotate in an inactive condition of the driving device.

5. A web driving device according to claim 1 comprising:

a web configured to scrub an object;

a winding axis connected to a first end of the web, and configured to rotate and wind the web in a winding direction;

a supplying axis connected to a second end of the web, and configured to supply a new part of the web and rotate in a supplying direction;

a driving device configured to drive the winding axis in the winding direction;

lock means for preventing the winding axis from rotating in a direction opposite to the winding direction; and restricting means for restricting rotation of the supplying axis when the winding axis stops rotating, wherein the restricting means is driven by the driving device when the driving device is active and the restricting means is stopped when the driving device is inactive, wherein;

the restricting means has a set of gears between the driving device and the supplying axis;

a first gear of the set of gears is driven by the driving device in synchronism with a driving condition of the driving device and a second gear of the set of gears is driven by the supplying axis; and the first gear and the second gear each have at least one lug so that the supplying axis is restricted from rotating when the at least one lug of the first gear is engaged with the at least one lug of the second gear in an inactive condition of the driving device.

6. A web driving device comprising:

a web configured to scrub an object;

a winding axis connected to a first end of the web, and configured to rotate and wind the web in a winding direction;

a supplying axis connected to a second end of the web, and configured to supply a new part of the web and rotate in a supplying direction;

a driving device configured to drive the winding axis in the winding direction;

lock means for preventing the winding axis from rotating in a direction opposite to the winding direction; and restricting means for restricting rotation of the supplying axis when the winding axis stops rotating, wherein the restricting means is driven by the driving device when the driving device is active and the restricting means is stopped when the driving device is inactive, further comprising a first protrusion rotatably equipped in the supplying axis, wherein;

the restricting means has a restricting gear configured to rotate in a direction opposite to the supplying direction and a second protrusion configured to rotate with the restricting gear; and the supplying axis is restricted from rotating when the first protrusion is engaged with the second protrusion in an inactive condition of the driving device.

7. A web driving device according to claim 6, wherein;

the restricting gear rotates faster than the first protrusion of the supplying axis; and when the restricting gear passes the first protrusion of the supplying axis in an active condition of the driving device, then the supplying axis is moved away by the second protrusion of the restricting gear.

8. A web driving device according to claim 7, wherein:

a rotational speed of the supplying axis increases over time; and the restricting gear rotates faster than the first protrusion of the supplying axis in a late stage of an unwinding of the web from the supplying axis.

9. A web driving device comprising:

a web;

a winding axis connected to a first end of the web, and configured to rotate and wind the web about the winding axis in a winding direction;

a supplying axis connected to a second end of the web, and configured to rotate in a supplying direction;

a driving device configured to drive the winding axis in the winding direction, the driving device being configured to prevent rotation of the winding axis when the driving device is in an inactive condition; and an intermediate gear device engaged to the winding axis, and configured to allow relative rotation between the supplying axis and the winding axis in a first direction and to prevent relative rotation between the supplying axis and the winding axis in a second direction opposite the first direction in order to restrict rotation of the supplying axis in the supplying direction when the winding axis stops rotating.

10. A web driving device according to claim 9, wherein:

the driving device includes at least one transferring gear engaged to the winding axis; and the intermediate gear device is engaged to the at least one transferring gear.

11. A web driving device comprising:

a web;

a winding axis connected to a first end of the web, and configured to rotate and wind the web about the winding axis in a winding direction;

a supplying axis connected to a second end of the web, and configured to rotate;

a driving device configured to drive the winding axis in the winding direction, the driving device being configured to prevent rotation of the winding axis when the driving device is in an inactive condition; and an intermediate gear device engaged to the winding axis, and configured to restrict rotation of the supplying axis when the winding axis stops rotating, wherein:

the supplying axis includes a first protrusion fixed thereto;

the intermediate gear device includes a second protrusion fixed thereto; and the second protrusion is configured to engage the first protrusion to prevent the supplying axis from rotating in at least one direction when the driving device is in the inactive condition.

12. A web driving device according to claim 11, wherein the first protrusion and the second protrusion are configured to allow relative rotation between the supplying axis and the intermediate gear device in a first direction but prevent relative rotation between the supplying axis and the intermediate gear device in a direction opposite to the first direction.

13. A web driving device according to claim 12, wherein:

the first protrusion is incorporated in a cam surface attached to the supplying axis; and the supplying axis is biased towards the intermediate gear device to maintain contact between the second protrusion and the cam surface during rotation of the supplying axis and the intermediate gear device.

14. A web driving device comprising:

a web;

a winding axis connected to a first end of the web, and configured to rotate and wind the web about the winding axis in a winding direction;

a supplying axis connected to a second end of the web, and configured to rotate;

a driving device configured to drive the winding axis in the winding direction, the driving device being configured to prevent rotation of the winding axis when the driving device is in an inactive condition; and an intermediate gear device engaged to the winding axis, and configured to restrict rotation of the supplying axis when the winding axis stops rotating, wherein the supplying axis includes a one-way gear assembly having a one-way clutch configured to engage the supplying axis to the intermediate gear device and prevent the supplying axis from rotating in at least one direction when the driving device is in the inactive condition.

15. A web driving device comprising:

a web;

a winding axis connected to a first end of the web, and configured to rotate and wind the web about the winding axis in a winding direction;

a supplying axis connected to a second end of the web, and configured to rotate;

a driving device configured to drive the winding axis in the winding direction, the driving device being configured to prevent rotation of the winding axis when the driving device is in an inactive condition; and an intermediate gear device engaged to the winding axis, and configured to restrict rotation of the supplying axis when the winding axis stops rotating, wherein;

the intermediate gear device includes a first portion engaged to the supplying axis and having a first tooth;

the intermediate gear device includes a second portion engaged to the winding axis and having a second tooth; and the second tooth is configured to engage the first tooth to prevent the supplying axis from rotating in at least one direction when the driving device is in the inactive condition.

16. A web driving device according to claim 15, wherein the first tooth and the second tooth are configured to allow relative rotation between the first portion and the second portion in a first direction but prevent relative rotation between the first portion and the second portion in a direction opposite to the first direction.

* * * * *